US007654520B2

(12) United States Patent
Lee

(10) Patent No.: US 7,654,520 B2
(45) Date of Patent: Feb. 2, 2010

(54) SHEET-HANDLING APPARATUS WITH A DETECTING DEVICE

(75) Inventor: Yueh-Shing Lee, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 94 days.

(21) Appl. No.: 11/935,942

(22) Filed: Nov. 6, 2007

(65) Prior Publication Data

US 2009/0116856 A1 May 7, 2009

(51) Int. Cl.
*B65H 7/08* (2006.01)
*B65H 7/02* (2006.01)

(52) U.S. Cl. ..... 271/261; 271/227; 271/265.03; 271/265.02; 271/259

(58) Field of Classification Search ..... 271/227, 271/261, 259, 258.01, 265.01, 265.02, 265.03
See application file for complete search history.

(56) References Cited

U.S. PATENT DOCUMENTS 4,484,070 A * 11/1984 Inoue ..... 250/223 R
5,260,564 A * 11/1993 Bruggeling et al. ..... 250/223 R
5,262,637 A * 11/1993 Cumberledge et al. .. 250/223 R
6,794,633 B2 * 9/2004 Iwasaki ..... 250/221
7,396,175 B2 * 7/2008 Ueda ..... 400/708
7,401,779 B2 * 7/2008 Sekiya et al. ..... 271/265.01
2008/0036138 A1 * 2/2008 Wang ..... 271/255

FOREIGN PATENT DOCUMENTS

JP 05058511 A * 3/1993
JP 06100205 A * 4/1994

* cited by examiner

*Primary Examiner*—Patrick H Mackey
*Assistant Examiner*—Luis Gonzalez
(74) *Attorney, Agent, or Firm*—WPAT, P.C.; Anthony King; Kay Yang

(57) ABSTRACT

A sheet-handling apparatus with a detecting device includes a casing, a plurality of entrance rollers located in the casing, an image collector arranged at one side of the casing, a plurality of middle reflectors and side reflectors. A paper path is formed between the entrance rollers, the paper path includes a middle path and two side paths arranged in the sides of the middle path. The image collector includes an illuminant and an image sensor. The middle reflectors are fixed in the casing and at the other side of the paper path and face to the middle path. The side reflectors are arranged at the side of the middle reflectors. The invention can monitor a paper when it is stuck in the paper path, and the manufacture cost of the invention is reduced.

9 Claims, 2 Drawing Sheets

SHEET-HANDLING APPARATUS WITH A DETECTING DEVICE

BACKGROUND OF THE INVENTION

1. Field of the Invention

The present invention relates to a sheet-handling apparatus, and more specifically to a sheet-handling apparatus with a detecting device for feeding a document or a paper.

2. The Related Art

In an image reading apparatus or a printing apparatus, a sheet-handling apparatus is provided for automatically feeding a sheet into the image reading apparatus or the printing apparatus.

In order to monitor a paper delivered into the apparatus, a detecting device is arranged in the sheet-handling apparatus. The detecting device includes a pressure sensor and a front pendulous arm. The pressure sensor connects to a processor. When a paper is fed into the sheet-handling apparatus, the front end of the paper pushes the front pendulous arm, and the front pendulous arm pushes the pressure sensor, so the pressure sensor delivers a signal into the processor. When the paper entirely passes through the front pendulous arm, the front pendulous arm returns to the start status, and a signal is delivered into the processor to inform the processor that the paper has passed through the front pendulous arm entirely.

The pressure sensor and the front pendulous arm are only arranged in a certain position in the sheet-handling apparatus, so it cannot monitor different width papers.

SUMMARY OF THE INVENTION

An object of the invention is to provide a sheet-handling apparatus with a detecting device comprising a casing, a plurality of entrance rollers arranged in the casing, an illuminant, a lens, an image sensor, a plurality of mirrors, middle reflectors and side reflectors. A paper path is formed between the entrance rollers. The paper path includes a middle path and two side paths arranged in the sides of the middle path. The illuminant, the image sensor, the mirrors and the lens are arranged in the case and under the paper path, the middle reflectors are arranged in the case and above the paper path. The side reflectors are arranged at the same side of the paper path with the middle reflector and facing to the corresponding side paths. When the light from the illuminant is projected onto the middle reflectors, the reflected light from the middle reflectors is reflected into the lens by the mirrors, the lens focuses the reflected light onto the image sensor. The mirrors locate between the paper path and the image sensor. The image sensor connects a processor. The illuminant, the mirrors, the lens and the image sensor compose an image collector. A board is arranged in the casing and above the paper path. The middle reflectors are arranged in the middle of the board and face to the corresponding middle path.

Another object of the invention is to provide a sheet-handling apparatus with a detecting device comprising: a casing; a plurality of entrance rollers located in the casing, a paper path formed between the entrance rollers, the paper path including a middle path and two side paths arranged at two sides of the middle path; an image collector including an illuminant and an image sensor, the image collector arranged in the case and at one side of the paper path; and two side reflectors fixed in the case and at the other side of the paper path and facing to the corresponding side paths.

As above description, the middle reflectors, the side reflectors and the image sensor are used to detect the front end and the sides of the paper, for the different optical reflectivity of the middle reflector, the side reflector and the paper, the image sensor can transform the light from the paper, the side reflectors and the middle reflectors into different signal, so the invention can detect every standard paper. And the manufacture cost of the invention is reduced, and the volume of the invention is reduced.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
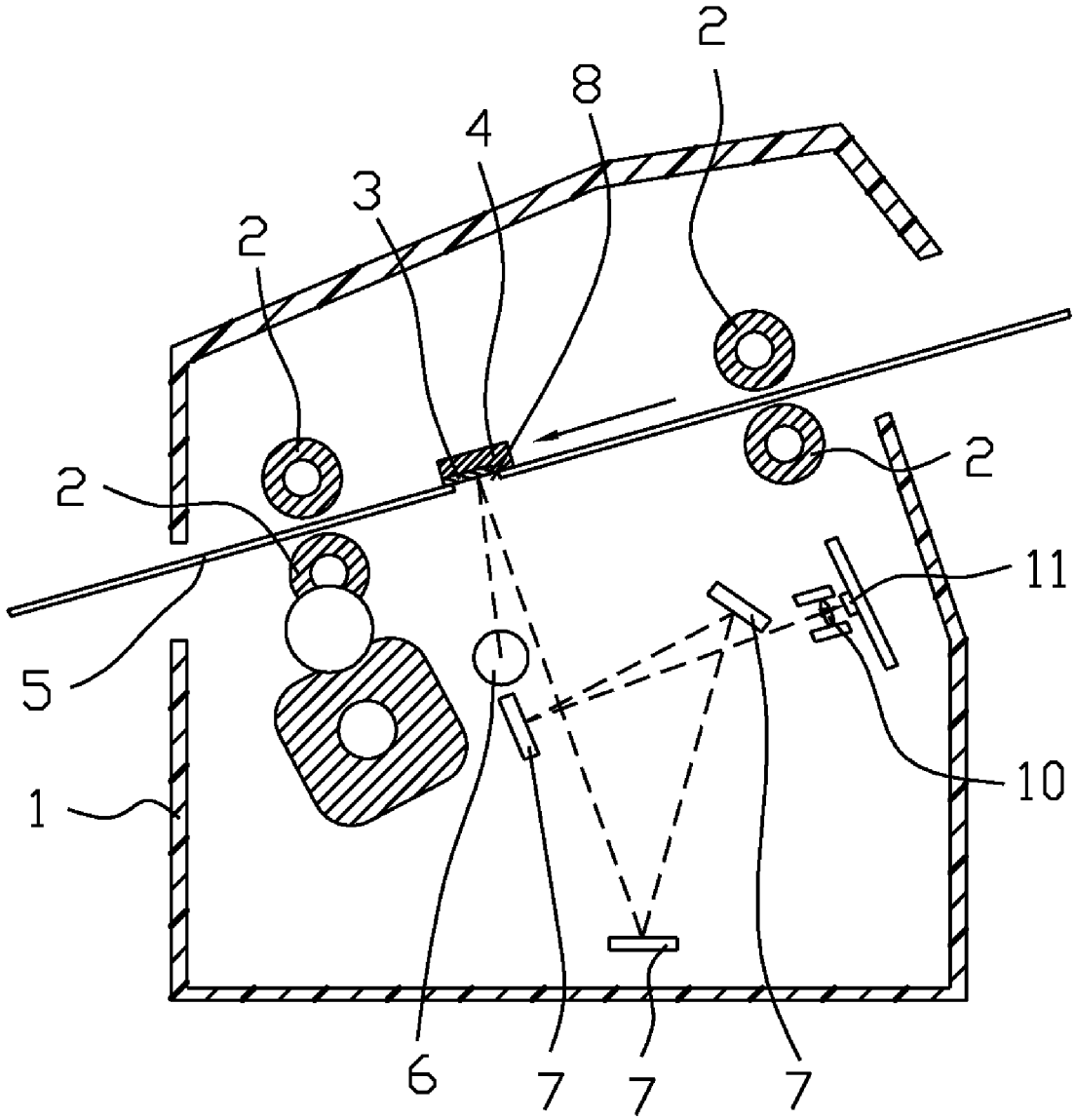
FIG. 1 is a structural view showing a sheet-handling apparatus with a detecting device.
Figure 2:
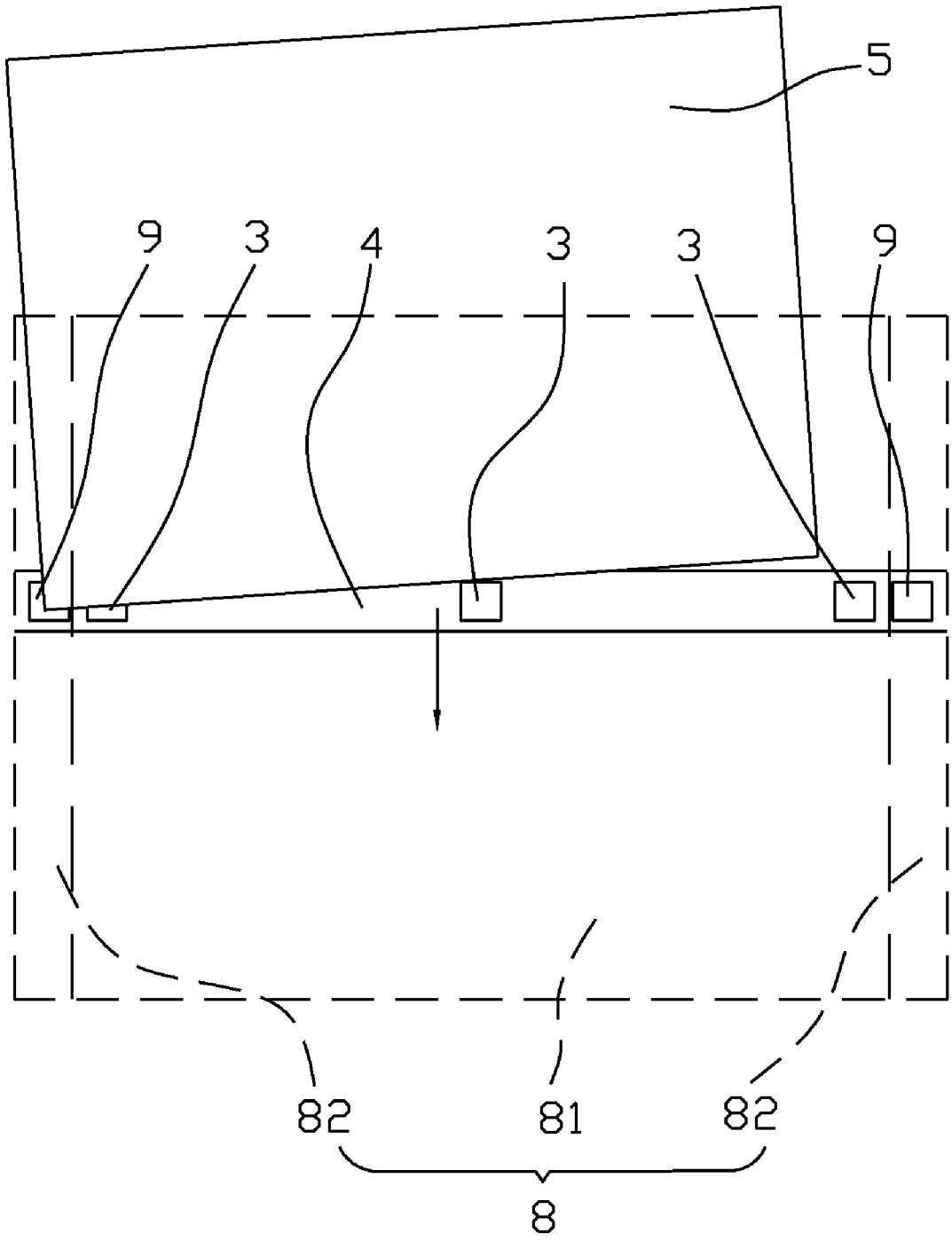
FIG. 2 is a schematic view showing a using embodiment of the sheet-handling apparatus with a detecting device.

First referring to FIGS. 1 and 2, a sheet-handling apparatus with a detecting device 100 according to the invention is shown. The sheet-handling apparatus with a detecting device 100 comprises a casing 1, four entrance rollers 2 arranged in the casing 1. A paper path 8 is formed between the entrance rollers 2. The paper path 8 includes a middle path 81 and two side paths 82 arranged in two sides of the middle path 81.

The detecting device includes an illuminant 6, an image sensor 11, three pieces of mirrors 7 and a lens 10. The illuminant 6, the image sensor 11, the three mirrors 7 and the lens 10 are arranged in the casing 1. When the light from the illuminant 6 is projected onto a paper 5, the reflected light from the paper 5 is reflected by the mirrors 7 into the lens 10, the lens 10 focuses the reflected light onto the image sensor 11. The illuminant 6, the mirrors 7, the lens 10 and the image sensor 11 compose an image collector. The image sensor 11 may be a CCD sensor, a CSI sensor or a CMOS sensor, etc.

A board 4 is arranged in the casing 1 and above the paper path 8. Three middle reflectors 3 are arranged at the middle and two sides of the board 4 respectively. Two side reflectors 9 are arranged at the two sides of the board 4 and outside the three middle reflectors 3.

When the paper 5 does not get into the paper path 8, the light from the illuminant 6 is projected into the middle reflectors 3 and then is reflected by the middle reflectors 3 and the mirrors 7 into the lens 10, the lens 10 focuses the reflected light onto the image sensor 11. When the paper 5 is delivered along the paper path 8, the middle reflectors 3 are sheltered by the paper 5 entirely or partly, the light from the illuminant 6 is projected into the paper 5 and then is reflected by the paper 5 and the mirrors 7 into the lens 10, the lens 10 focuses the reflected light from the mirrors 7 onto the image sensor 11.

The optical reflectivity of the paper 5 is much less than the optical reflectivity of the middle reflector 3. When the light from the illuminant 6 is projected into the middle reflector 3 or the paper 5, for the different optical reflectivity of the middle reflector 3 and the paper 5, the power of the reflected light from the middle reflector 3 is stronger than the power of the reflected light from the paper 5, so the signal intensity from the image sensor 11 according to the reflected light from the middle reflector 3 is higher than the signal intensity from the image sensor 11 according to the reflected light from the paper 5. According to the different signal intensity, the sheet-handling apparatus can detect that if the paper 5 is running on the paper path 8. When the three middle reflectors 3 are not sheltered by the paper 5. If the signal intensity from the image sensor 11 is relatively high, the paper 5 is not delivered into the sheet-handling apparatus with a detecting device 100; if the signal intensity from the image sensor 11 is relatively low, the paper 5 is delivering along the paper path 8, the three middle reflectors 3 are sheltered entirely or partly by the paper 5.

When the paper 5 does not get into the paper path 8, or the paper 5 is delivered along the middle path 81, the light from the illuminant 6 is projected into the side reflectors 9 and then is reflected by the side reflectors 9 and the mirrors 7 into the lens 10, the lens 10 focuses the reflected light onto the image sensor 11. When the paper 5 is obliquely delivered along the paper path 8, a part of the paper 5 gets into the side path 82 of the paper path 8, and one of the side reflectors 9 is sheltered by the paper 5, the light from the illuminant 6 is projected into one side of the paper 5 and then is reflected by the paper 5 and the mirrors 7 into the lens 10, the lens 10 focuses the reflected light into the image sensor 11. For the different reflectivity of the side reflector 9 and the paper 5, when the two side reflectors 9 are not sheltered, the power of the reflected light is stronger than the power of the reflected light when one of the side reflectors 9 are sheltered by the paper 5 in the side path 82, then the signal intensity from the image sensor 11 when the two side reflectors 9 not sheltered is higher than the signal intensity from the image sensor 11 when one of the side reflectors 9 sheltered. Therefore, a conclusion is obtained that no paper is delivered into the sheet-handling apparatus with a detecting device 100, or the paper 5 is delivered along the middle path 81, if the signal intensity from the image sensor 11 is relatively high; if the signal intensity from the image sensor 11 is relatively low, the paper 5 shelters the side reflectors 9 partly, then the entrance rollers 2 will stop revolving at once to avoid that the paper 5 is stuck in the sheet-handling apparatus.

In this embodiment, the image sensor connects a processor in a scanner or a printer. For the middle reflectors 3 and the side reflectors 9 design, the manufacture cost of the invention is reduced, and the volume of the invention is reduced.

As above description, the middle reflectors 3 and the image sensor 11 are used to monitor the front end of the paper 5, for the different optical reflectivity of the middle reflector 3 and the paper 5, the image sensor 11 can transform the light from the paper 5 and the middle reflectors 3 into different signal.

The side reflectors 9 and the image sensor 11 are used to monitor the sides of the paper 5 slanted along the paper path 8, for the different optical reflectivity of the side reflectors 9 and the paper 5, the image sensor 11 can transform the light from the paper 5 and the side reflectors 9 into different signal. Then, the invention can monitor the paper 5 when it is stuck in the paper path 8.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A sheet-handling apparatus with a detecting device, comprising:

a casing;

a plurality of entrance rollers located in the casing, a paper path formed between the entrance rollers, the paper path including a middle path for normal paper feeding and two side paths arranged at two sides of the middle path;

an image collector including an illuminant and an image sensor, the image collector arranged in the casing and at one side of the paper path;

at least one middle reflector fixed in the case and the other side of the paper path and facing to the middle path;

a side reflector arranged at the same side of the paper path with the middle reflector and facing to the corresponding side path; and a board arranged in the casing and above the paper path, the middle reflector and the side reflectors fixed in the board.

2. The sheet-handling apparatus with a detecting device as set forth in claim 1, wherein the two sides of the middle path dispose two said middle reflectors.

3. The sheet-handling apparatus with a detecting device as set forth in claim 1, further comprising a plurality of mirrors and a lens, the mirror reflects light from a paper, the middle reflector or the side reflector into the lens, the lens focuses the light into the image sensor.

4. The sheet-handling apparatus with a detecting device as set forth in claim 1, wherein the image sensor is a CCD sensor, a CMOS sensor or a CIS sensor.

5. A sheet-handling apparatus with a detecting device for monitoring a paper delivery, comprising:

a casing;

a plurality of entrance rollers located in the casing, a paper path formed between the entrance rollers, the paper path including a middle path for normal paper feeding and two side paths arranged at two sides of the middle path;

an image collector including an illuminant and an image sensor, the image collector arranged in the casing and at one side of the paper path;

at least one middle reflector fixed in the case and at the other side of the paper path and facing to the middle path, the light from the illuminant capable of being directly reflected by the middle reflector to cross the middle path and then transmitted to the image sensor for monitoring whether the paper is passing therefrom or not; and a side reflector arranged at the same side of the paper path with the middle reflector and facing to the corresponding side path, the light from the illuminant capable of being directly reflected by the side reflector to cross the side path and then transmitted to the image sensor for monitoring whether the paper is deflective from the middle path to the side path or not, wherein the middle reflector for detecting the front edge of the paper and the side reflectors for detecting the side edge of the paper are in a line.

6. The sheet-handling apparatus with a detecting device as set forth in claim 5 wherein the two sides of the middle path dispose two said middle reflectors.

7. The sheet-handling apparatus with a detecting device as set forth in claim 5, further comprising a plurality of mirrors and a lens, the mirror reflects light from a paper, the middle reflector or the side reflector into the lens, the lens focuses the light into the image sensor.

8. The sheet-handling apparatus with a detecting device as set forth in claim 5, wherein the image sensor is a CCD sensor, a CMOS sensor or a CIS sensor.

9. A sheet-handling apparatus with a detecting device for monitoring a paper delivery, comprising:

a casing;

a plurality of entrance rollers located in the casing, a paper path formed between the entrance rollers, the paper path including a middle path for normal paper feeding and two side paths arranged at two sides of the middle path;

an image collector including an illuminant and an image sensor, the image collector arranged in the casing and at one side of the paper path;

at least one middle reflector fixed in the case and at the other side of the paper path and facing to the middle path, the light from the illuminant capable of being directly reflected by the middle reflector to cross the middle path and then transmitted to the image sensor for monitoring whether the paper is passing therefrom or not;

a side reflector arranged at the same side of the paper path with the middle reflector and facing to the corresponding side path, the light from the illuminant capable of being directly reflected by the side reflector to cross the side path and then transmitted to the image sensor for monitoring whether the paper is deflective from the middle path to the side path or not; and a board arranged in the casing and above the paper path, the middle reflector and the side reflectors fixed in the board.

* * * * *